US007563552B2

(12) United States Patent
Kaiho et al.

(10) Patent No.: US 7,563,552 B2
(45) **Date of Patent: *Jul. 21, 2009**

(54) METHOD FOR PRODUCING LIQUID DEVELOPER, LIQUID DEVELOPER, AND IMAGE FORMING APPARATUS

(75) Inventors: Hiroshi Kaiho, Matsumoto (JP); Satoru Miura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 263 days.

This patent is subject to a terminal disclaimer.

(21) Appl. No.: 11/461,692

(22) Filed: Aug. 1, 2006

(65) Prior Publication Data

US 2007/0026338 A1 Feb. 1, 2007

(30) Foreign Application Priority Data

Aug. 1, 2005 (JP) ..... 2005-223425

(51) Int. Cl.
*G03G 9/125* (2006.01)

(52) U.S. Cl. ..... 430/116; 430/137.22; 399/239

(58) Field of Classification Search ..... 430/116, 430/137.19, 137.22
See application file for complete search history.

(56) References Cited

U.S. PATENT DOCUMENTS 5,789,133 A * 8/1998 Yabuuchi et al. ..... 430/115
2006/0142425 A1* 6/2006 Akioka et al. ..... 523/223

FOREIGN PATENT DOCUMENTS

JP 2002-214849 7/2002

* cited by examiner

*Primary Examiner*—John L Goodrow
(74) *Attorney, Agent, or Firm*—Hogan & Hartson LLP

(57) ABSTRACT

A method for producing a liquid developer comprising an insulation liquid and toner particles dispersed in the insulation liquid is provided. The method comprising the steps of: a wet grinding step for grinding a toner material mainly composed of a resin material in a first liquid which contains as its main component a fatty acid monoester to obtain a ground material dispersed liquid; and a mixing step for mixing the ground material dispersed liquid and a second liquid which contains as its main component a fatty acid triglyceride, wherein the first and second liquids constitute the insulation liquid, and the ground resin material dispersed in the insulation liquid constitutes the toner particles. According to the producing method, it is possible to produce a liquid developer in which toner particles having a sufficiently small size are stably dispersed with high production efficiency. Further, a liquid developer produced by the method and an image forming apparatus are also provided.

12 Claims, 4 Drawing Sheets

METHOD FOR PRODUCING LIQUID DEVELOPER, LIQUID DEVELOPER, AND IMAGE FORMING APPARATUS

CROSS-REFERENCE TO RELATED APPLICATION

This application claims priority to Japanese Patent Application No. 2005-223425 filed on Aug. 1, 2005 which is hereby expressly incorporated by reference herein in its entirety.

BACKGROUND OF THE INVENTION

1. Field of the Invention

The present invention relates to a method for producing a liquid developer, a liquid developer, and an image forming apparatus for use with the liquid developer.

2. Description of the Prior Art

As a developer used for developing an electrostatic latent image formed on a latent image carrier, there are known two types. One type of such a developer is known as a dry toner which is formed of a material containing a coloring agent such as a pigment or the like and a binder resin, and such a dry toner is used in a dry condition thereof. The other type of such a developer is known as a liquid developer which is obtained by dispersing toner particles into a carrier liquid having electric insulation properties.

A dry toner is generally produced using a dry grinding method in which a coloring agent and a material containing a binder resin are ground in a dry condition. In the developing method using such a dry toner, since a solid state toner is used, there is an advantage in handleability thereof. On the other hand, however, this method involves problems in that contamination is likely to be caused by dispersal of toner powder and toner particles are likely to be massed together in a cartridge. Further, in such a dry toner, since aggregation of toner particles is likely to occur during preservation and the like, it is difficult to obtain toner particles each having a sufficiently small diameter. This means that it is difficult to form a toner image having high resolution. Furthermore, there is also a problem in that when the size of the toner particle is made to be relatively small, the problems resulted from the powder form of the dry toner described above become more serious.

On the other hand, in the developing method using a liquid developer, since aggregation of toner particles in the liquid developer during preservation is unlikely to occur comPared to the dry toner due to the use of an insulation liquid, it is possible to use very fine toner particles. As a result, compared to the method using the dry toner, the method using the liquid developer has such advantages as good reproductivity of an image composed of thin lines, good tone reproductivity as well as good reproductivity of colors. Further, the method using the liquid developer is also superior as a method for forming an image at high speed.

As a method for producing such a liquid developer, there in known a wet grinding method in which a material containing a coloring agent and a resin is ground in an electric insulation liquid to thereby produce a liquid developer (one example of such a method is disclosed in JP-A No. 8-36277).

Although a recent trend of a higher-resolution image requires further finer toner particles, it is difficult to grind toner particles into sufficiently small pieces using such a conventional liquid developer producing method. Further, in the conventional liquid developer producing method, in order to produce toner particles having a sufficiently small size, a considerably large amount of grinding energy is required for a prolonged period of time, thus resulting in significantly low productivity of a liquid developer. In addition, according to the above-mentioned conventional method, particle size distribution of toner particles is likely to become large, namely toner particles are likely to have large variations in their particle sizes. As a result, relatively large variations are likely to be caused in the properties of the toner particles such as chargeable characteristics thereof. Instead of the wet grinding method, the dry grinding method described above may be used for producing a liquid developer. In this case, however, it is extremely difficult to obtain fine particles suitable for toner particles for a liquid developer. That is, it is difficult to obtain toner particles having a relatively small size since aggregation of toner particles is likely to occur.

Further, in the conventional wet grinding method, it is difficult to obtain a liquid developer in which dispersibility of toner particles is sufficiently high. In a case where dispersibility of toner particles is insufficient, there is a problem in that toner particles settle down when being left for a long period of time, whereby causing aggregation of toner particles. Additionally, if once aggregation of toner particles occurs, it is difficult to re-disperse the aggregated toner particles by agitation. Therefore, there is a problem in that toner particles cannot be supplied uniformly when forming an image.

SUMMARY OF THE INVENTION

Accordingly, it is an object of the present invention to provide a method for producing a liquid developer in which toner particles having a sufficiently small size are dispersed stably and by which such a liquid developer can produced effectively.

Further, it is another object of the present invention is to provide a liquid developer in which toner particles having a sufficiently small size are dispersed stably, and an image forming apparatus for use with the liquid developer.

In order to achieve the above mentioned objects, one aspect of the present invention is directed to a method for producing a liquid developer which comprises an insulation liquid and toner particles dispersed in the insulation liquid, the method comprising the steps of a wet grinding step for grinding a toner material mainly composed of a resin material in a first liquid which contains as its main component a fatty acid monoester to obtain a ground material dispersed liquid and a mixing step for mixing the ground material dispersed liquid and a second liquid which contains as its main component a fatty acid triglyceride, wherein the first and second liquids constitute the insulation liquid, and the ground resin material dispersed in the insulation liquid constitutes the toner particles.

According to the present invention described above, it is possible to effectively produce a liquid developer in which toner particles having a sufficiently small size are dispersed stably.

In the liquid developer producing method according to the present invention, it is preferred that the viscosity of the first liquid is in the range of 0.5 to 60 mPa·s.

This makes it possible to produce toner particles having a sufficiently small size more effectively.

In the liquid developer producing method according to the present invention, it is also preferred that the viscosity of the second liquid is in the range of 30 to 500 mPa·s.

This makes it possible for the insulation liquid (liquid developer) to have desirable viscosity. Further, dispersibility of the toner particles can be made further higher.

In the liquid developer producing method according to the present invention, it is also preferred that the first liquid contains a dispersant, and the toner material is ground in such first liquid in the wet grinding step.

The dispersant serves as a grinding support agent so that toner particles having a sufficiently small size can be obtained more effectively and dipersibility of toner particles to be obtained can be made further higher.

In the liquid developer producing method according to the present invention, it is also preferred that the fatty acid monoester is an unsaturated fatty acid alkyl ester.

According to this, the grinding efficiency can further be improved, whereby making it possible to produce toner particles having a small size more effectively.

In the liquid developer producing method according to the present invention, it is also preferred that the fatty acid monoester is an oleic acid alkyl ester.

According to this, the grinding efficiency can further be improved, whereby making it possible to produce toner particles having a small size more effectively.

In the liquid developer producing method according to the present invention, it is also preferred that the second liquid contains an unsaturated fatty acid triglyceride as the fatty acid triglyceride.

This makes it possible to make dispersibility of toner particles further higher.

In the liquid developer producing method according to the present invention, it is also preferred that wherein the resin material includes at least one of an epoxy resin and a polyester resin.

This makes it possible to produce toner particles having a sufficiently small size more effectively as well as to make dispersibility of toner particles in a liquid developer further higher.

Another aspect of the present invention is directed to a liquid developer which comprises an insulation liquid comprising a first liquid which contains as its main component a fatty acid monoester and a second liquid which contains as its main component a fatty acid triglyceride and toner particles dispersed in the insulation liquid, wherein the toner particles are obtained through a wet grinding process in which a toner material mainly composed of a resin material is ground in the first liquid so that the ground toner material is finely dispersed in the first liquid, and the liquid developer is obtained by mixing the first liquid containing the ground toner material with the second liquid.

According to this, a liquid developer in which toner particles having a sufficiently small size are dispersed stably can be provided.

Yet another aspect of the present invention is directed to an image forming apparatus for forming an image onto a recording medium using a liquid developer, wherein the liquid developer comprises an insulation liquid comprising a first liquid which contains as its main component a fatty acid monoester and a second liquid which contains as its main component a fatty acid triglyceride and toner particles dispersed in the insulation liquid, wherein the toner particles are obtained through a wet grinding process in which a toner material mainly composed of a resin material is ground in the first liquid so that the ground toner material is finely dispersed in the first liquid, and the liquid developer is obtained by mixing the first liquid containing the ground toner material with the second liquid.

In the image forming apparatus described above, it is preferred that the image forming apparatus comprises a liquid developer storage section for storing the liquid developer therein, a developing section for developing a toner image using the liquid developer supplied from the liquid developer storage section, and the developing section including a photoreceptor on which a latent image is to be formed and an application roller and a development roller for supplying the liquid developer in the liquid developer storage section to the photoreceptor for developing the latent image, an image transfer section for transferring the developed latent image formed on the photoreceptor onto the recording medium to form a transferred image thereon, and a fixing section for fixing the transferred image formed on the recording medium onto the recording medium.

Further, in the image forming apparatus described above, it is also preferred that a part of the application roller is immersed in the developer in the liquid developer storage section.

These and other objects, structures and effects of the present invention will be more apparent when the following detailed description of the preferred embodiments and the examples will be considered taken in conjunction with the appended drawings.

DETAILED DESCRIPTION OF THE PREFERRED EMBODIMENTS

Hereinbelow, with reference to the accompanying drawings, preferred embodiments of a method for producing a liquid developer, a liquid developer produced by the method, and an image forming apparatus for use with the liquid toner according to the present invention will be described in details.

A liquid developer of the present invention includes an insulation liquid and toner particles dispersed in the insulation liquid. The insulation liquid contains a first liquid which contains as its main component a fatty acid monoester and a second liquid which contains as its main component a fatty acid triglyceride.

Hereinbelow, a method for producing a liquid developer according to the present invention will be described in details. The method for producing a liquid developer according to the present invention includes a grinding process for grinding a toner material mainly composed of a resin material in the first liquid to thereby obtain a ground material dispersed liquid and a mixing process for mixing the ground material dispersed liquid and the second liquid.

<<Preparation of Toner Material>>

Figure 1:
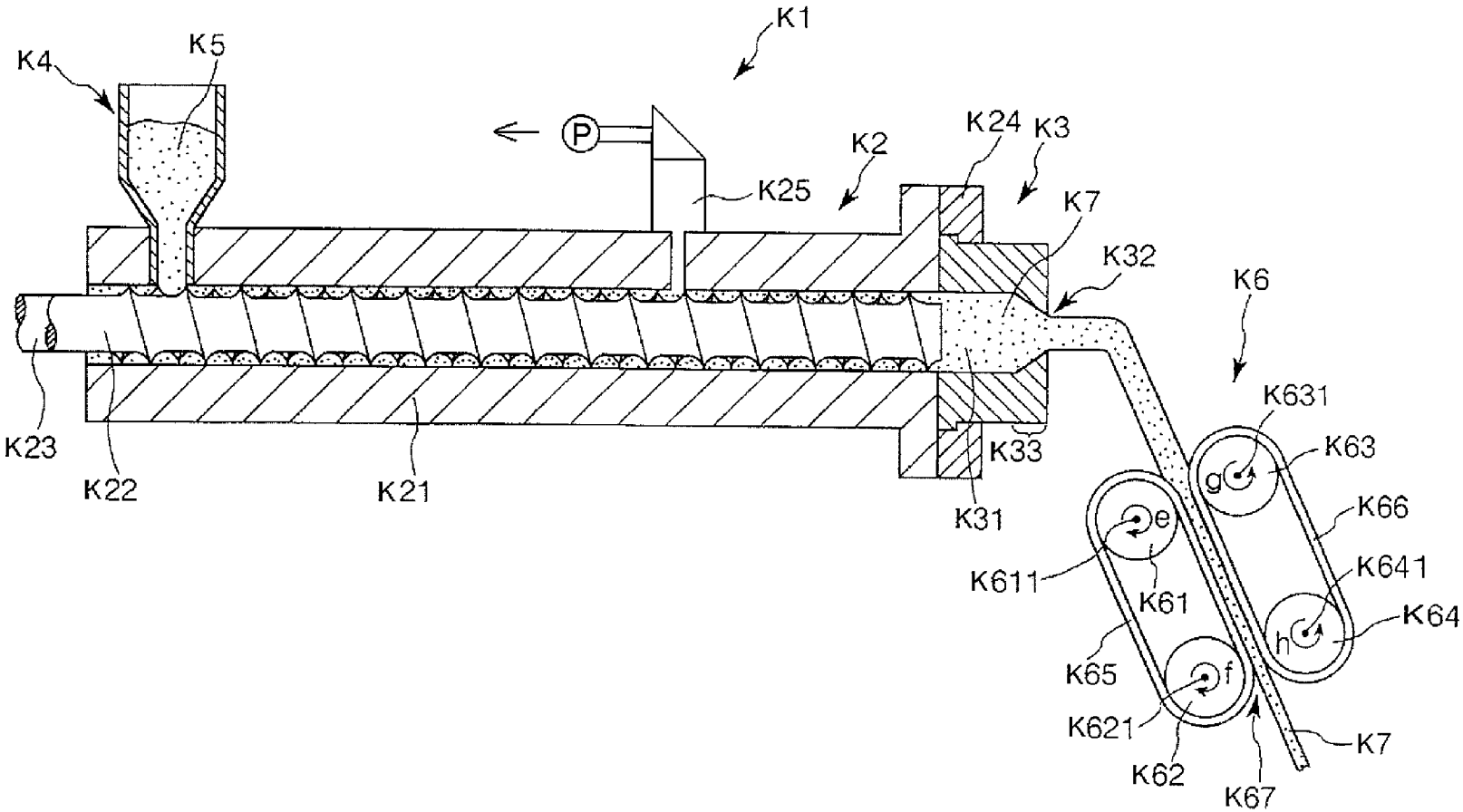
FIG. 1 is a vertical cross-sectional view which schematically shows one example of the structure of a kneading machine and a cooling machine used in a liquid developer producing method according to the present invention.

First, one example of a method for preparing a toner material will be described. FIG. 1 is a vertical cross-sectional view which schematically shows one example of the structure of a kneading machine and a cooling machine for producing a kneaded material used for preparing a toner material.

<Toner Material>

Hereinbelow, a description will be made with regard to constituent materials of a toner material used for producing the liquid developer. The toner material is mainly composed of a resin material (resin).

1. Resin (Binder Resin)

In the present invention, there is no specific limitation on the kinds of a resin material (binder resin) to be used.

Examples of such a resin (binder resin) include styrene-based resins (homopolymers or copolymers containing styrene or a styrene substituent) such as polystyrene, poly-α-methylstyrene, chloropolystyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic ester copolymer, styrene-methacrylic ester copolymer, styrene-acrylic ester-methacrylic ester copolymer, styrene-α-methyl chloroacrylate copolymer, styrene-acrylonitrile-acrylic ester copolymer, and styrene-vinyl methyl ether copolymer, polyester-based resins, epoxy resins, urethane-modified epoxy resins, silicone-modified epoxy resins, vinyl chloride resins, rosin-modified maleic acid resins, phenyl resins, polyethylene-based resins, polypropylene, ionomer resins, polyurethane resins, silicone resins, ketone resins, ethylene-ethylacrylate copolymer, xylene reins, polyvinyl butyral resins, terpene reins, phenol resins, and aliphatic or alicyclic hydrocarbon resins. These binder resins can be used singly or in combination of two or more of them.

The amount of the resin material contained in the toner material is preferably equal to or more than 55 wt %, and more preferably equal to or more than 70 wt %. The softening point of the resin (resin material) is not particularly limited to any specific value, but it is preferably in the range of 50 to 130° C., more preferably in the range of 50 to 120° C., and even more preferably in the range of 60 to 115° C. In this specification, the term "softening point" means a temperature at which softening begins under the conditions that a temperature raising speed is 5° C./mim and a diameter of a die hole is 1.0 mm in a high-floored flow tester (manufactured by Shimadzu Corporation).

2. Coloring Agent

The toner material of the liquid developer may contain a coloring agent. As for a coloring agent, pigments, dyes or the like can be used. Examples of such pigments and dyes include Carbon Black, Spirit Black, Lamp Black (C.I. No. 77266), Magnetite, Titanium Black, Chrome Yellow, Cadmium Yellow, Mineral FEast Yellow, Navel Yellow, Naphthol Yellow S, Hansa Yellow G, Permanent Yellow NCG, Benzidine Yellow, Quinoline Yellow, Tartrazine Lake, Chrome Orange, Molybdenum Orange, Permanent Orange GTR, Pyrazolone Orange, Benzidine Orange X, Cadmium Red, Permanent Red 4R, Watching Red Calcium Salt, Eosine Lake, Brilliant Carmine 3B, Manganese Violet, Fast Violet B, Methyl Violet Lake, Prussian Blue, Cobalt Blue, Alkali Blue Lake, Victoria Blue Lake, Fast Sky Blue, Indanthrene Blue BC, Ultramarine Blue, Aniline Blue, Phthalocyanine Blue, Chaico Oil Blue, Chrome Green, Chromium Oxide, Pigment Green B, Malachite Green Lake, Phthalocyanine Green, Final Yellow Green G, Rhodamine 6G, Quinacridone, Rose Bengal (C.I. No. 45432), C.I. Direct Red1, C.I. Direct Red 4, C.I. Acid Red1, C.I. Basic Red1, C.I. Mordant Red 30, C.I. Pigment Red 48:1, C.I. Pigment Red 57:1, C.I. Pigment Red 122, C.I. Pigment Red 184, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Pigment Blue 15:1, C.I. Pigment Blue 15:3, C.I. Pigment Blue 5:1, C.I. Direct Green 6, C.I. Basic Green 4, C.I. Basic Green 6, C.I. Pigment Yellow 17, C.I. Pigment Yellow 93, C.I. Pigment Yellow 97, C.I. Pigment Yellow 12, C.I. Pigment Yellow 180, C.I. Pigment Yellow 162, and Nigrosine Dye (C.I. No. 50415B); metal oxides such as metal complex dyes, silica, aluminum oxide, magnetite, maghemite, various kinds of ferrites, cupric oxide, nickel oxide, zinc oxide, zirconium oxide, titanium oxide, magnesium oxide, and the like; and magnetic materials including magnetic metals such as Fe, Co, and Ni; and the like. These pigments and dyes can be used singly or in combination of two or more of them.

3. Other Components

Further, additional components other than the above components may be contained in the toner material. Examples of such other components include a wax, a charge control agent, a magnetic powder, and the like.

Examples of such a wax include hydrocarbon wax such as ozokerite, ceresin, paraffin wax, micro wax, microcrystalline wax, petrolatum, Fischer-Tropsch wax, or the like; ester wax such as carnauba wax, rice wax, methyl laurate, methyl myristate, methyl palmitate, methyl stearate, butyl stearate, candelilla wax, cotton wax, Japan wax, beeswax, lanolin, montan wax, fatty ester, or the like; olefin wax such as polyethylene wax, polypropylene wax, oxidized polyethylene wax, oxidized polypropylene wax, or the like; amide wax such as 12-hydroxystearic acid amide, stearic acid amide, phthalic anhydride imide, or the like; ketone wax such as laurone, stearone, or the like; ether wax; and the like. These waxes can be used singly or in combination of two or more.

Examples of the charge control agent include a metallic salt of benzoic acid, a metallic salt of salicylic acid, a metallic salt of alkylsalicylic acid, a metallic salt of catechol, a metal-containing bisazo dye, a nigrosine dye, tetraphenyl borate derivatives, a quaternary ammonium salt, an alkylpyridinium salt, chlorinated polyester, nitrohumic acid, and the like.

Further, examples of the magnetic powder include a powder made of a magnetic material containing a metal oxide such as magnetite, maghemite, various kinds of ferrites, cupric oxide, nickel oxide, zinc oxide, zirconium oxide, titanium oxide, magnesium oxide, or the like, and/or magnetic metal such as Fe, Co or Ni.

Further, the constituent material of the toner particles may further contain zinc stearate, zinc oxide, cerium oxide, silica, titanium oxide, iron oxide, fatty acid, or fatty acid metal salt, or the like in addition to the components described above.

<Kneading Process>

In this embodiment, the toner material is prepared by kneading the above-mentioned components. The material K5 to be kneaded contains the components as described above. Since the material K5 contains a coloring agent, air contained in the coloring agent is likely to be included in the material K5. This means that there is a possibility that air bubble may enter the inside of the toner particles. However, since the material K5 is subjected to the kneading process in this step, it is possible to eliminate air contained in the material K5 efficiently, and it is therefore possible to prevent air bubble from entering the inside of the toner particle effectively, that is, prevent air bubble from remaining inside the toner particles effectively. Further, it is preferred that the material K5 to be kneaded is prepared in advance by mixing the above-mentioned various components.

In this embodiment, a biaxial kneader-extruder is used as the kneading machine, a detail of which will be described below.

The kneading machine K1 includes a process section K2 which kneads the material K5 while conveying it, a head section K3 which extrudes a kneaded material K7 so that an extruded kneaded material can have a prescribed cross-sectional shape, and a feeder K4 which supplies the material K5 into the process section K2.

The process section K2 has a barrel K21, screws K22 and K23 inserted into the barrel 21, and a fixing member K24 for fixing the head section K3 to the front portion of the barrel K21.

In the process section K2, a shearing force is applied to the material K5 supplied from the feeder K4 by the rotation of the screws K22 and K23 so that a homogeneous kneaded material K7 is obtained.

In this embodiment, it is preferred that the total length of the process section K2 is in the range of 50 to 300 cm, and more preferably in the range of 100 to 250 cm. If the total length of the process section K2 is less than the above lower limit value, there is a case that it is difficult to mix and knead the components in the material K5 homogeneously. On the other hand, if the total length of the process section K2 exceeds the above upper limit value, there is a case that thermal modification of the material K5 is likely to occur depending on the temperature inside the process section K2, the number of revolutions of the screws K22 and K23, or the like, thus leading to a possibility that it becomes difficult to control the physical properties of a finally obtained liquid developer (that is, a resultant liquid toner) sufficiently.

In this connection, the temperature of the material (material temperature) during the kneading step is preferably in the range of 80 to 260° C., and more preferably in the range of 90 to 230° C. though it varies depending on the composition of the material K5 and the like. In this regard, it is to be noted that the temperature of the material inside the process section K2 may be constant throughout the process section K2 or different depending on positions inside the process section K2. For example, the process section K2 may include a first region in which an internal temperature is set to be relatively low and a second region which is provided at the base side of the first region and in which an internal temperature is set to be higher than the internal temperature of the first region-Moreover, it is preferred that the residence time of the material K5 in the process section K2, that is the time required for the material K5 to pass through the process section K2, is 0.5 to 12 minutes, and more preferably 1 to 7 minutes. If the residence time of the material K5 in the process section K2 is less than the above lower limit value, there is a possibility that it is difficult to mix the components in the material K5 homogeneously. On the other hand, if the residence time of the material K5 in the process section K2 exceeds the above upper limit value, there is a possibility that production efficiency is lowered, and thermal modification of the material K5 is likely to occur depending on the temperature inside the process section K2 or the number of revolutions of the screws K22 and K23 or the like, thus resulting in a case that it is difficult to control the physical properties of a finally obtained liquid developer (that is, a resultant liquid toner) satisfactorily.

Although the number of revolutions of the screws K22 and K23 varies depending on the compositions of the binder resin or the like, it is preferably in the range of 50 to 600 rpm. If the number of revolutions of the screws K22 and K23 is less than the above lower limit value, there is a case that it is difficult to mix the components of the material K5 homogeneously. On the other hand, if the number of revolutions of the screws K22 and K23 exceeds the above upper limit value, there is a case that molecular chains of the resin are cut due to a shearing force, thus resulting in the deterioration of the characteristics of the resin.

In the kneading machine K1 used in this embodiment, the inside of the process section K2 is connected to a pump P through a duct K25. This makes it possible to deaerate the inside of the process section K2, thereby enabling to prevent the pressure inside the process section K2 from raising due to heated-up or heat generation of the material K5 (kneaded material K7). As a result, the kneading step can be carried out safely and effectively. Further, since it is possible to prevent air bubble (in particular, relatively large air bubble) from being contained in the kneaded material K7 effectively, a liquid developer (that is, a liquid toner) having excellent properties can be obtained.

<Extrusion Process>

The kneaded material K7 which has been kneaded in the process section K2 is extruded to the outside of the kneading machine K1 via the head section K3 by the rotation of the screws K22 and K23.

The head section K3 has an internal space K31 to which the kneaded material K7 is sent from the process section K2, and an extrusion port K32 through which the kneaded material K7 is extruded.

In this connection, it is preferred that the temperature (temperature at least in the vicinity of the extrusion port K32) of the kneaded material K7 in the internal space K31 is higher than the softening point of the resin materials contained in the material K5. When the temperature of the kneaded material K7 is such a temperature, it is possible to obtain toner particles in which the components thereof are homogeneously mixed, thereby enabling to make variations in their properties such as charging characteristics, fixing characteristics, and the like especially small.

The concrete temperature of the kneaded material K7 inside the internal space K31 (that is, the temperature of the kneaded material K7 at least in the vicinity of the extrusion port K32) is not limited to a specific temperature, but is preferably in the range of 80 to 150° C., and more preferably in the range of 90 to 140° C. In the case where the temperature of the kneaded material K7 in the internal space K31 is within the above range, the kneaded material K7 is not solidified inside the internal spade K31 so that it can be extruded from the extrusion port 32K easily.

The internal space K31 having a structure as shown in FIG. 1 includes a cross sectional area reduced portion K33 in which a cross sectional area thereof is gradually reduced toward the extrusion port K32. Due to the cross sectional area reduced portion K33, the extrusion amount of the kneaded material K7 which is to be extruded from the extrusion port 32K becomes stable, and the cooling rate of the kneaded material K7 in a cooling process which will be described later also becomes stable. As a result of this, variations in properties of the obtained toner particles can be made small, whereby enabling to produce a liquid developer (that is, a liquid toner) having excellent properties.

<Cooling Process>

The kneaded material K7 in a softened state extruded from the extrusion port K32 of the head section K3 is cooled by a cooler K6 and it is thereby solidified.

The cooler K6 has rolls K61, K62, K63 and K64, and belts K65 and K66.

The belt K65 is wound around the rolls K61 and K62, and similarly, the belt 66 is wound around the rolls K63 and K64.

The rolls K61, K62, K63 and K64 rotate in directions shown by the arrows e, f, g and h in the drawing about rotary shafts K611, K621, K631 and K641, respectively. With this arrangement, the kneaded material K7 extruded from the extrusion port K32 of the kneading machine K1 is introduced into the space between the belts K65 and K66. The kneaded material K7 is then cooled while being molded into a plate-like object with a nearly uniform thickness, and is ejected from an ejection part K67. The belts K65 and K66 are cooled by, for example, an air cooling or water cooling method. By using such a belt type cooler, it is possible to extend a contact time between the kneaded material extruded from the kneading machine and the cooling members (belts), thereby enabling the cooling efficiency for the kneaded material to be especially excellent.

Now, during the kneading process, since the material K5 is subjected to a shearing force, phase separation (in particular, macro-phase separation) can be prevented. However, since the kneaded material K7 which has been discharged out of the kneading process is free from the shearing force, there is a possibility that phase separation (in particular, macro-phase separation) will occur again if such a kneaded material is being left for a long period of time. Accordingly, it is preferable to cool the thus obtained kneaded material K7 as quickly as possible. More specifically, it is preferred that the cooling rate (for example, the cooling rate when the kneaded material K7 is cooled down to about 60° C.) of the kneaded material K7 is faster than 3° C./sec, and more preferably in the range of 5 to 100° C./sec. Moreover, the time between the completion of the kneading process (at which the kneaded material is free from the shearing force) and the completion of the cooling process (time required to lower the temperature of the kneaded material K7 to 60° C. or lower, for example) is preferably 20 seconds or less, and more preferably in the range of 3 to 12 seconds.

In the above embodiment, a description has been made in terms of an example using a continuous biaxial kneader-extruder as the kneading machine, but the kneading machine used for kneading the material is not limited to this type. For kneading the material, it is possible to use various kinds of kneading machines, for example, a kneader, a batch type triaxial roll, a continuous biaxial roll, a wheel mixer, a blade mixer, or the like.

Further, although in the embodiment shown in the drawing the kneading machine is of the type that has two screws, the number of screws may be one or three or more. Further, the kneading machine may have a disc section (kneading disc section).

Furthermore, in the embodiment described above, one kneading machine is used for kneading the material, but kneading may be carried out by using two kneading machines. In this case, the heating temperature of the material and the rotational speed of the screws of one kneading machine may be different from those of the other kneading machine.

Moreover, in the above embodiment, the belt type cooler is used, but a roll type (cooling roll type) cooler may be used. Furthermore, cooling of the kneaded material extruded from the extrusion port K32 of the kneading machine is not limited to the way using the cooler described above, and it may be carried out by air cooling, for example.

<Coarse Grinding Process>

Next, the kneaded material K7 obtained through the cooling process described above is coarsely ground to thereby obtain a coarse ground material which can be used as the toner material. By using such a coarse ground material obtained by coarsely grinding the kneaded material K7, it becomes possible to obtain toner particles having a smaller size more effectively in a wet grinding process described later.

The method of coarse grinding is not particularly limited. For example, such coarse grinding may be carried out by employing various kinds of grinding machines or crushing machines such as a ball mill, a vibration mill, a jet mill, a pin mill, or the like.

The coarse grinding process may be carried out by dividing it into a plurality of stages.

<<Preparation of Liquid Developer>>

Next, a liquid developer is prepared using the toner material that has been prepared as described above.

<Wet Grinding Process (Fine Grinding Process)>

First, the toner material obtained as described above is subjected to wet grinding to thereby obtain a ground material dispersed liquid. In the present invention, the wet grinding is carried out using a first liquid which contains as its main material fatty acid monoester.

Since the toner material can move freely in the first liquid due to relatively low viscosity of the first liquid and the resistance of the first liquid is low, it is possible to finely grind the coarse ground material effectively. Further, since the first liquid has good compatibility with the resin materials described above as well as it has relatively low viscosity, it can enter minute cracks generated in the toner material (coarse ground material) due to the grinding process or the like. Consequently, it becomes possible to finely grind the coarse ground material effectively to form toner particles having a small diameter. In addition to this, it is possible to accelerate the grinding rate thereof. Further, since grinding energy can be used effectively for grinding the toner material by grinding it in the first liquid having relatively low viscosity, it is possible to prevent the temperature of the first liquid from being increased. As a result of this, even in the case where the toner material is composed of a resin material having a relatively low melting point, it can also be ground effectively.

Examples of the fatty acid monoester constituting such a first liquid include alkyl (e.g., methyl, ethyl, propyl, butyl and the like) esters of unsaturated fatty acid (e.g., oleic acid, palmitoleic acid, linoleic acid, α-linolenic acid, γ-linolenic acid, arachidonic acid, docosahexaenoic acid (DHA), eicosapentaenoic acid (EPA) and the like), alkyl (e.g., methyl, ethyl, propyl, butyl and the like) esters of saturated fatty acid (e.g., butyric acid, caproic acid, caprylic acid, capric acid, lauric acid, myristic acid, palmitic acid, stearic acid, arachic acid, behenic acid, lignoceric acid and the like), and the like. These fatty acid monoesters can be used singly or in combination of two or more of them.

Among these fatty acid monoesters, an unsaturated fatty acid alkyl ester can enter minute cracks generated in the toner material due to the grinding and the like easily since it has especially good compatibility with the above-mentioned resin materials (in particular, an epoxy resin and polyester resin) as well as it has low viscosity. Therefore, the grinding efficiency can further be improved, thus toner particles having a small diameter can be produced more effectively.

In particular, in a case where a methyl oleate is used, the above-mentioned effect can be exhibited more remarkably.

Further, the above-mentioned fatty acid monoester can contribute to improving the fixing characteristics of the finally obtained liquid developer since the fatty acid monoester adhering to the toner particles is cured by an oxidation polymerization reaction during the fixing process.

The amount of the fatty acid monoester contained in the first liquid is preferably equal to or more than 60 wt %, and more preferably equal to or more than 80 wt %. Further, the viscosity of the fist liquid at room temperature (20° C.) is preferably in the range of 0.5 to 60 mPa·s, more preferably in the range of 1 to 50 mPa·s, and even more preferably in the range of 1 to 10 mPa·s. By using the first liquid having the viscosity within such a range, toner particles having a sufficiently small diameter can be obtained more effectively.

Although the electric resistance of the first liquid is not limited to any specific value as long as the first liquid has sufficiently high insulation property, the electric resistance of the first liquid at room temperature (20° C.) is preferably equal to or more than $10^9$ Ωcm, more preferably equal to or more than $10^{11}$ Ωcm, and even more preferably equal to or more than $10^{13}$ Ωcm. This results in the insulation liquid having higher electric resistance (insulation property).

The method of wet grinding is not particularly limited. For example, such wet grinding may be carried out by employing various kinds of grinding machines or crushing machines such as a ball mill, a vibration mill, a jet mill, a pin mill, or the like. The wet grinding process may be carried out by dividing it into a plurality of stages.

In this regard, a dispersant (surfactant) may be added into the first liquid before mixing the first liquid and the toner material. The dispersant serves as a grinding support agent so that the toner material can be ground more effectively and dispersibility of the toner particles to be obtained can be made further higher. Further, if the kneaded material K7 is ground in the first liquid containing a dispersant, the dispersant is easy to adhere to the surfaces of the toner particles. Therefore, electrification property (chargeable characteristics) of the finally obtained liquid developer can be improved.

Examples of the dispersant include macromolecular dispersants such as polyvinyl alcohol, carboxymethyl cellulose, polyethylene glycol, SOLSPERSE (product of Lubrizol Japan Ltd.), polycarboxylic acid and salts thereof, polyacrylic acid metal salts (e.g., sodium salts), polymethacrylic acid metal salts (e.g., sodium salts), polymaleic acid metal salts (e.g., sodium salts), metal salts of acrylic acid-maleic acid copolymers (e.g., sodium salts), polystyrenesulfonic acid metal salts (e.g., sodium salts), aliphatic polyamine condensation polymer; and the like. Further, examples of the dispersant include viscosity mineral, silica, tricalcium phosphate, tristearic acid metal salts (e.g., aluminum salts), distearic acid metal salts (e.g., aluminum salts and barium salts), stearic acid metal salts (e.g., calcium salts, lead salts, and zinc salts), linolenic acid metal salts (e.g., cobalt salts, manganese salts, lead salts, and zinc salts), octanoic acid metal salts (e.g., aluminum salts, calcium salts, and cobalt salts), oleic acid metal salts (e.g., calcium salts and cobalt salts), palmitic acid metal salts (e.g., zinc salts), dodecylbenzenesulfonic acid metal salts (e.g., sodium salts), naphthenic acid metal salts (e.g., calcium salts, cobalt salts, manganese salts, lead salts, and zinc salts), resin acid metal salts (e.g., calcium salts, cobalt salts, manganese salts, and zinc salts), and the like.

Among these materials, it is possible to improve the grinding efficiency effectively in a case where the macromolecular dispersant is used. Further, if the macromolecular dispersant is contained in the first liquid in which the toner material is ground, the macromolecular dispersant can suitably adhere to the surfaces of the toner particles, whereby making it possible to keep the first liquid on or around the surfaces of the toner particles more effectively when mixing the first liquid and a second liquid which will be described later. As a result, the dispersibility of the toner particles in the finally obtained liquid developer can further be improved. In particular, among these macromolecular dispersants, the above-mentioned effects will be remarkably exhibited when using the SOLSPERSE.

<Mixing Process>

Next, the thus obtained ground material dispersed liquid and the second liquid which contains as its main component a fatty acid triglyceride are mixed to thereby obtain a liquid developer. Namely, the insulation liquid constituting the liquid developer contains the first liquid and the second liquid. By producing the liquid developer in such a manner, it is possible for the toner particles to have high dispersibility because of the following reasons.

Since the toner material is subjected to wet grinding using the first liquid which contains as its main component fatty acid monoester, each of the toner particles in the obtained ground material dispersed liquid is coated with the fatty acid monoester. Further, the fatty acid monoester and the fatty acid triglyceride constituting the second liquid have excellent compatibility with each other since they have similar structure (namely, similar ester structure). Therefore, it is possible to obtain the toner particles having high dispersibility by mixing the ground material dispersed liquid and the second liquid in the above-mentioned state. Further, the fatty acid triglyceride constituting the second liquid has relatively high viscosity. Thus, it is possible to obtain the liquid developer having appropriate viscosity by mixing the second liquid and the first liquid having relatively low viscosity, and as a result, the obtained liquid developer can have excellent dispersibility of the toner particles. Furthermore, since the dispersibility of the toner particles can be improved by producing the liquid developer in such a manner, it is possible to supply the liquid developer (toner particles) to an application roller P12 uniformly while preventing the liquid developer from dripping off from the application roller P12 effectively in an image forming apparatus P1 which will be described later.

In particular, an epoxy resin or a polyester resin is used as a resin material constituting the toner material when producing the liquid developer, the following effect can be obtained.

In a case where the resin material contains at least either an epoxy resin or a polyester resin, since these resins have particularly excellent compatibility with the first liquid, the first liquid can enter cracks or the like generated in the toner material due to the grinding or the like more effectively, whereby making it possible to grind the toner material more effectively. Further, since the toner particles can be coated with the first liquid more reliably when mixing the first liquid and the second liquid, it becomes possible to make the dispersibility of the toner particles further higher.

The fatty acid triglyceride constituting the second liquid is a component which is harmless to the environment. Therefore, it is possible to reduce an adverse effect on the environment caused by volatilization of the insulation liquid when it is used during the fixing process or disposal of the liquid developer. As a result, it is possible to provide a liquid developer which is harmless to the environment.

Examples of the fatty acid triglyceride constituting the second liquid include triglycerides of unsaturated fatty acid (e.g., oleic acid, palmitoleic acid, linoleic acid, α-linolenic acid, γ-linolenic acid, arachidonic acid, docosahexaenoic acid (DHA), eicosapentaenoic acid (EPA)), triglycerides of saturated fatty acid (e.g., butyric acid, caproic acid, caprylic acid, capric acid, lauric acid, myristic acid, palmitic acid, stearic acid, arachic acid, behenic acid, lignoceric acid), and the like. These components can be used singly or in combination of two or more of them. Among these fatty acid triglycerides, an unsaturated fatty acid triglyceride has good compatibility with the resin materials described above (especially, an epoxy resin and a polyester resin) and the fatty acid monoester (especially, unsaturated fatty acid monoester), it is therefore possible to make the dispersibility of the toner particles further higher.

The amount of the fatty acid triglyceride contained in the second liquid is preferably equal to or more than 60 wt % and more preferably equal to or more than 80 wt %. The fatty acid triglyceride is obtained effectively from naturally derived oils such as vegetable oils (e.g., soybean oil, rape oil, linseed oil, cottonseed oil, castor oil), animal oils (e.g., herring oil, sardine oil), and the like.

The viscosity of the second liquid at room temperature (20° C.) is not particularly limited to any specific value, but it is preferably in the range of 30 to 500 mPa·s, more preferably in the range of 30 to 300 mPa·s, and even more preferably in the range of 35 to 250 mPa·s. If the viscosity of the second liquid is within such a range, the viscosity of the insulation liquid (liquid developer) becomes a desirable value. As a result, it is possible to make the dispersibility of the toner particles further higher.

Further, when $V_1$ [mPa·s] represents the viscosity of the fist liquid and $V_2$ [mPa·s] represents the viscosity of the second liquid, it is preferred to satisfy the relation of $0.001 \leqq V_1/V_2 \leqq 1$, and more preferred to satisfy the relation of $0.003 \leqq V_1/V_2 \leqq 0.8$. By satisfying such a relation, it is possible to make the dispersibility of the toner particles further higher as well as to grind the toner material more effectively.

Furthermore, when A [wt %] represents the amount of the first liquid contained in the insulation liquid and B [wt %] represents the amount of the second liquid contained in the second liquid, it is preferred to satisfy the relation of $0.25 \leqq A/B \leqq 1.5$, and more preferred to satisfy the relation of $0.42 \leqq A/B \leqq 1$. By satisfying such a relation, it is possible to make the dispersibility of the toner particles further higher as well as to grind the toner material more effectively.

Moreover, although the electric resistance of the second liquid is not particularly limited to any specific value as long as the second liquid has sufficiently high insulation property, the electric resistance of the second liquid at room temperature (20° C.) is preferably equal to or more than $10^9$ Ωcm, more preferably equal to or more than $10^{11}$ Ωcm, and even more preferably equal to or more than $10^{13}$ Ωcm. According to this, it is possible to make the electric resistance (insulation property) of the insulation liquid further higher. In this regard, a liquid other than the first liquid and the second liquid may also be added.

The average particle size (diameter) of the toner particles in the liquid developer obtained in the above-described manner is preferably in the range of 0.1 to 4 μm, more preferably in the range of 0.4 to 4 μm, even more preferably in the range of 0.5 to 3 μm. If the average particle size of the toner particles is within the above range, variations in properties such as electrification property, fixing property or the like of the toner particles can be made sufficiently small. Consequently, it is possible to make resolution of a toner image formed from the liquid developer (liquid toner) sufficiently high so that the liquid developer can have high reliability as a whole.

Further, it is preferred that the standard deviation of particle size among the toner particles which constitute the liquid developer is 3.0 m or less, more preferably in the range of 0.1 to 2.0 μm, and even more preferably in the range of 0.1 to 1.0 μm. When the standard deviation of particle size lies within the above range, variations in properties such as electrification property, fixing property or the like of the toner particles can be made especially small, thereby further improving the reliability of the liquid developer as a whole.

Further, the viscosity of the liquid developer obtained as described above at room temperature (20° C.) is preferably in the range of 20 to 300 mPa·s, and more preferably in the range of 30 to 250 mPa·s. If the viscosity of the liquid developer is within the above range, it is possible to make the dispersibility of the toner particles further higher. In addition to this, it is also possible to supply the liquid developer to an application roller P12 uniformly while preventing the liquid developer from dripping off from the application roller P12 effectively in an image forming apparatus P1 which will be described later.

Furthermore, the viscosity of the insulation liquid contained in the obtained liquid developer at room temperature (20° C.) is preferably in the range of 10 to 250 mPa's, and more preferably in the range of 20 to 200 mPa's. When the viscosity of the insulation liquid is within such a range, the viscosity of the liquid developer becomes a desirable value, thereby resulting in further higher dispersibility of the toner particles.

Next, a description will be made with regard to preferred embodiments of an image forming apparatus to which the liquid developer of the present invention can be used.

Figure 2:
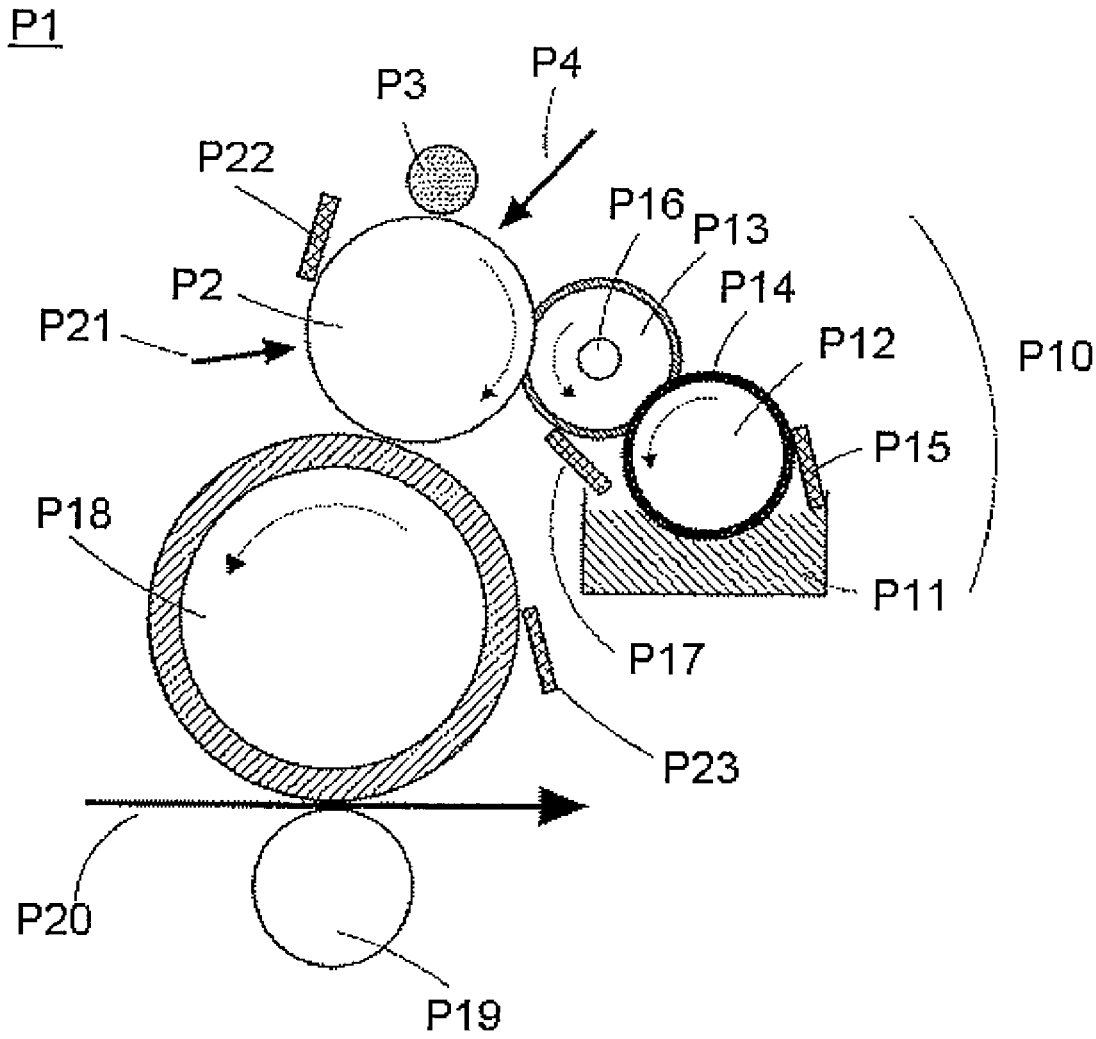
FIG. 2 is a cross-sectional view which shows one example of a contact type image forming apparatus in which the liquid developer of the present invention can be used.

FIG. 2 is an illustration which shows one example of a contact type image forming apparatus to which the liquid developer of the present invention can be used. The image forming apparatus P1 includes a photoreceptor P2 in the form of a cylindrical drum. After the surface of the photoreceptor P2 is uniformly charged with a charging device P3 made of an epichlorohydrin rubber or the like, exposure P4 corresponding to the information to be recorded is carried out using a laser diode or the like so that an electrostatic latent image is formed.

A developer P10 has an application roller P12 a part of which is immersed in a developer container (liquid developer storage section) P11 and a development roller P13. The application roller P12 is formed from, for example, a gravure roller made of stainless steel or the like, which rotates with opposing to the development roller P13. On the surface of the application roller P12, a liquid developer application layer P14 is formed, and the thickness of the layer is adapted to be kept constant by a metering blade P15. In particular, the toner particles in the liquid developer of the present invention have superior dispersibility, thus the liquid developer application layer P14 has an appropriate thickness and the toner particles are dispersed uniformly therein. Therefore, it becomes possible to obtain a clear and even image.

Further, a liquid developer is transferred from the application roller P12 to the development roller P13. The development roller P13 is constructed from a metallic roller core member P16 made from stainless steel or the like, a low hardness silicone rubber layer provided on the metallic core member P16, and a resin layer made of a conductive PEFA (polytetrafluoroetylene-perfluorovinylether copolymer) formed on the silicone rubber layer. The development roller P13 is adapted to rotate at the same speed as the photoreceptor P2 to transfer the liquid developer to a latent image section. A part of the liquid developer remaining on the development roller P13 after it has been transferred to the photoreceptor P2 is removed by the a development roller cleaning blade P17 and then collected in the developer container P11. In this regard, it is to be noted that the photoreceptor P2, the application roller P12, and the development roller P13, and other related elements constitute a developing section for developing a toner image using the liquid developer supplied from the liquid developer storage section.

Further, after a toner image is transferred from the photoreceptor to an intermediate transfer roller P18, the photoreceptor is discharged with discharging light P21, and a toner which has not been transferred and remains on the photoreceptor P2 is removed by a cleaning blade P22 made of a urethane rubber or the like.

The toner image formed on the photoreceptor P2 is transferred to the intermediate transfer roller P18. Then, a transfer current is supplied to a secondary transfer roller P19, and the toner image transferred on the intermediate roller P18 is transferred onto the recording medium P20 such as a paper which passes between the intermediate transfer rollers P18 and the secondary transfer roller P19. Namely, the intermediate transfer roller P18 constitutes an image transfer section for transferring the developed latent image formed on the photoreceptor onto a recording medium to form a transferred image thereon. In a similar manner, a toner which is not transferred and remains on the intermediate transfer roller P18 after the toner image has been transferred to the information recording medium P20 is removed by a cleaning blade P23 made of a urethane rubber or the like.

Figure 4:
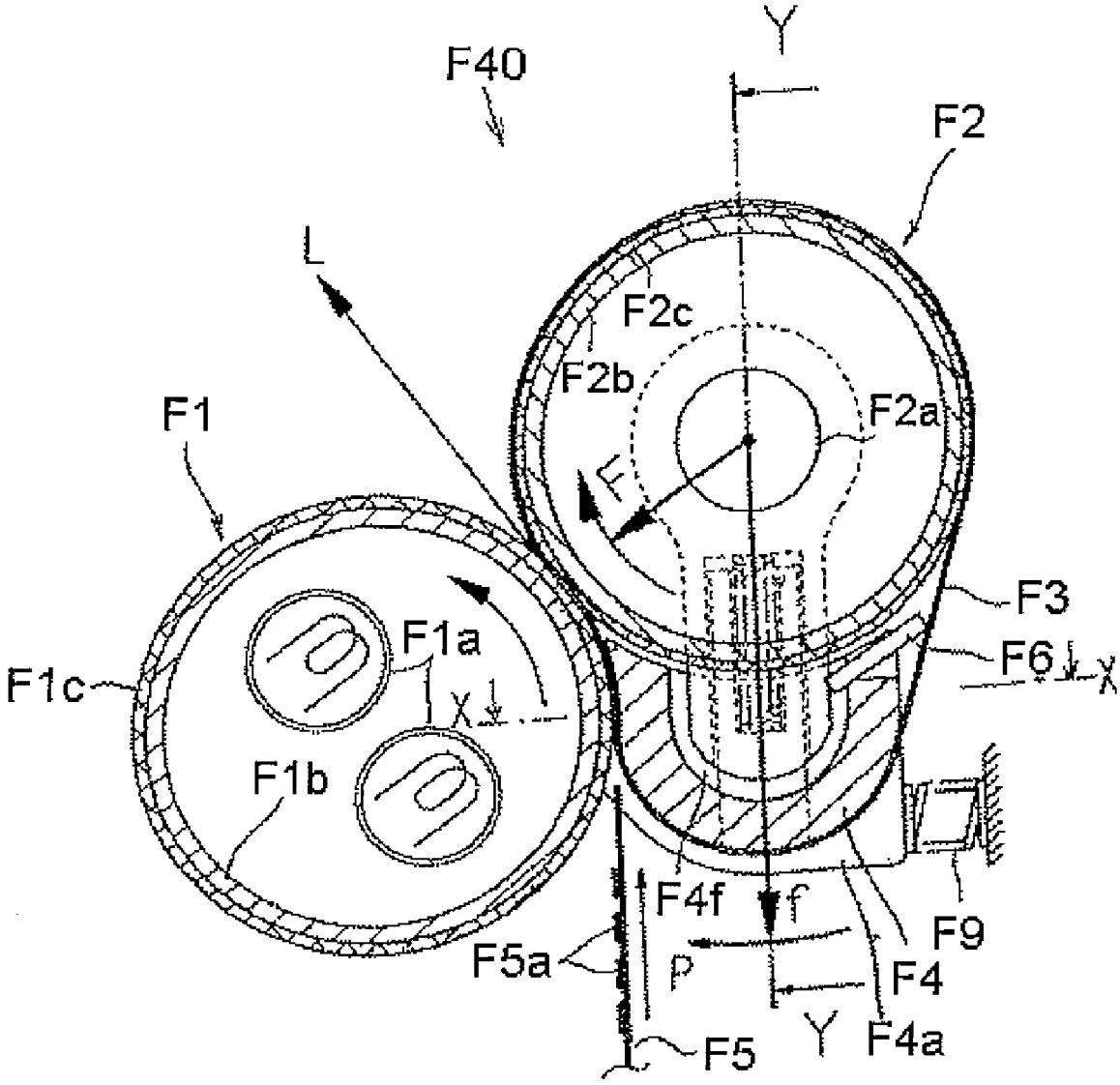
FIG. 4 is a cross-sectional view which shows one example of a fixing apparatus in which the liquid developer of the present invention can be used.

Thereafter, the toner image on the recording medium P20 is fixed thereto using a fixing unit (fixing section) shown in FIG. 4.

Figure 3:
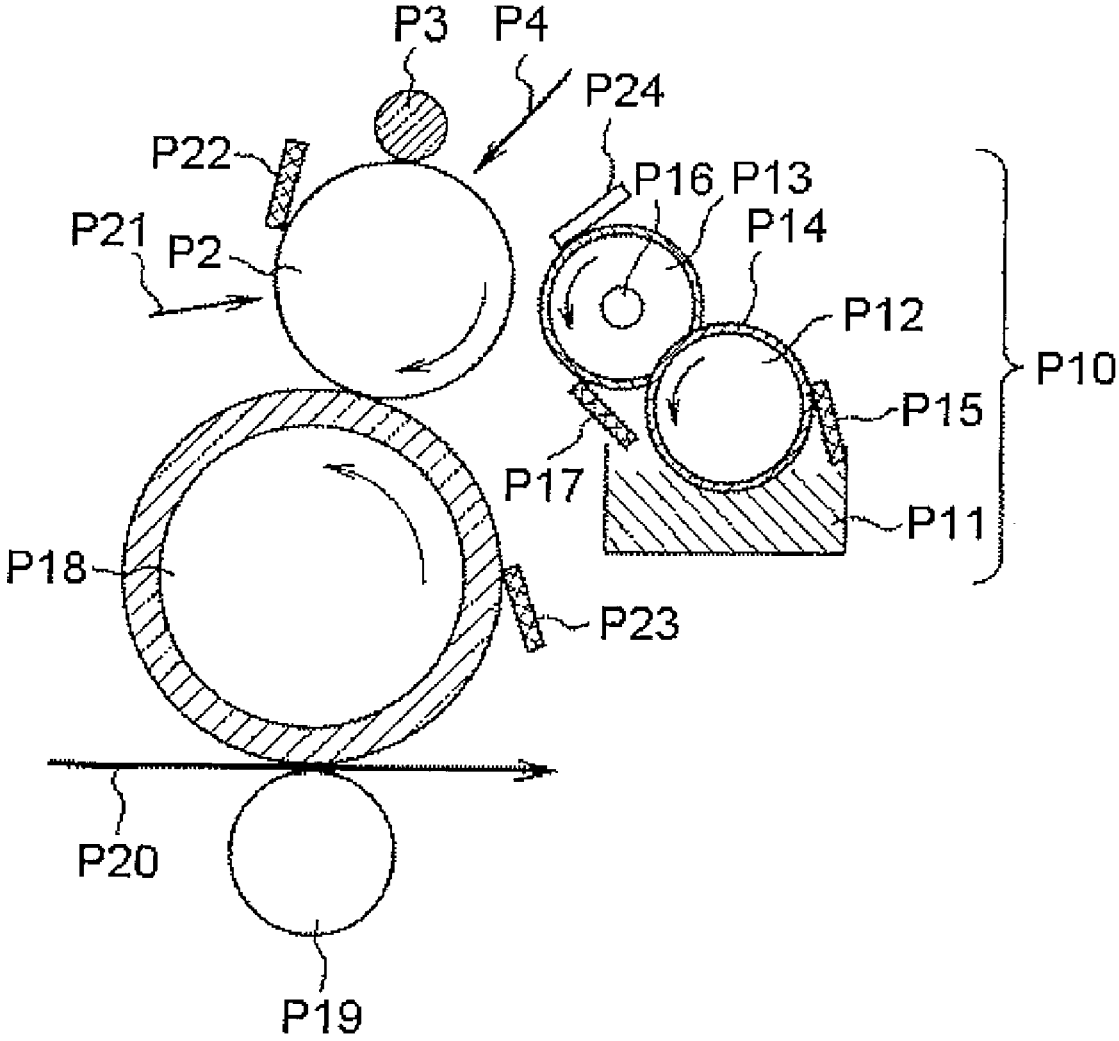
FIG. 3 is a cross sectional view whish shows one example of a non-contact type image forming apparatus in which the liquid developer of the present invention can be used.

FIG. 3 shows one example of a non-contact type image forming apparatus to which the liquid developer according to the present invention can be applied. In such a non-contact type image forming apparatus, a development roller P13 is provided with a charging blade P24 which is formed from a phosphor-bronze plate having a thickness of 0.5 mm. The charging blade P24 has a function of causing a layer of the liquid developer to be charged by contacting it. Further, since an application roller P12 is a gravure roller, a layer of a developer having irregularities which correspond to irregularities on the surface of the gravure roller is formed on the development roller P13. The charging blade P24 also has a function of uniforming the irregularities formed on the development roller P13. The orientation of the charging blade P24 is either of a counter direction or a trail direction with respect to the rotational direction of the development roller. Further, the charging blade P24 may be in the form of a roller not a blade.

Preferably, between the development roller P13 and the photoreceptor P2, there is formed a gap whose width is 200 μm to 800 μm, and an AC voltage having 500 to 3000 Vpp and a frequency of 50 to 3000 Hz which is superimposed on a DC voltage of 200 to 800 V is applied across the development roller P13 and the photoreceptor P2. Other structures of this non-contact type image forming apparatus are the same as those of the contact type image forming apparatus shown in FIG. 2.

In the foregoing, the description was made with regard to the image formation by the embodiments shown in FIGS. 2 and 3 in which a liquid developer of one color is used. However, it goes without saying that when an image is formed using color toners of a plurality of colors, a color image can be formed by using a plurality of development apparatuses corresponding to the respective colors to form images of the respective colors.

FIG. 4 is a cross-sectional view of a fixing unit, in which F1 denotes a heat fixing roller, F1*a* denotes halogen lamps, F1*b* is a roller base, F1*c* is an elastic body, F2 is a pressure roller, F2*a* is a rotation shaft, F2*b* is a roller base, F2*c* is an elastic body, F3 is a heat resistant belt, F4 is a belt tension member, F4*a* is a protruding wall, F5 is a sheet material, F5*a* is an unfixed toner image, F6 is a cleaning member, F7 is a frame, F9 is a spring, and L is a tangential line of a pressing part.

As shown in this figure, the fixing unit F40 includes the heat fixing roller (hereinafter, also referred to as "heat fuser roller") F1, the pressure roller F2, the heat resistant belt F3, the belt tension member F4, and the cleaning member F6.

The heat fixing roller F1 has the roller base F1*b* formed from a pipe member having an outer diameter of about 25 mm and a thickness of about 0.7 mm. The roller base F1*b* is coated with the elastic body F1*c* having a thickness of about 0.4 mm. Further, inside the roller base F1*b*, two halogen lamps F1*a* which act as a heat source is provided. Each of the halogen lamps F1*a* has a tubular shape and an output of 1,050W. The heat fixing roller F1 is rotatable in an anticlockwise direction shown by the arrow in FIG. 4. Further, the pressure roller F2 has the roller base F2*b* formed from a pipe member having an outer diameter of about 25 mm and a thickness of about 0.7 mm. The roller base F2*b* is coated with the elastic body F2*c* having a thickness of about 0.2 mm. The pressure roller F2 having the above structures is rotatable in a clockwise direction indicated by the arrow F in FIG. 4, and it is arranged so as to face the heat fixing roller F1 so that a pressing pressure between the heat fixing roller F1 and the pressure roller F2 becomes 10 kg or less and a nip length therebetween is about 10 mm.

As described above, each of the heat fixing roller F1 and the pressure roller F2 is formed to have a small outer diameter of about 25 mm, there is less possibility that a sheet material F5 after the fixing process is wound around the heat fixing roller F1 or the heat resistant belt F3, and thus it is not necessary to have any means for peeling off the sheet material F5 forcibly. Further, since the PFA layer having a thickness of about 30 μm is provided on the surface of the elastic member Flc of the heat fixing roller F1, the strength thereof is improved. By providing such a PFA layer, both the elastic members F1*c* and F2*c* are elastically deformed substantially uniformly though their thicknesses are different from each other, thereby forming a so-called horizontal nip. Further, there is no difference between the circumferential velocity of the heat fixing roller F1 and the conveying speed of the heat resistant belt F3 or the sheet material F5. For these reasons, it is possible to perform an extremely stable image fixation.

Further, as described above, the two halogen lamps F1*a*, F1*a* which act as a heat source are provided inside the heat fixing roller F1. These halogen lamps F1*a*, F1*a* are provided with heating elements, respectively, which are arranged at different positions. With this arrangement, by selectively lighting up any one or both of the halogen lamps F1*a*, F1*a*, it is possible to easily carry out a temperature control under different conditions such as a case where a wide sheet material is used or a narrow sheet material is used, and/or a case where a fixing nip part at which the heat resistant belt F3 is wound around the heat fixing roller F1 is to be heated or a part at which the belt tension member F4 is in slidably contact with the heat fixing roller F1 is to be heated.

The heat resistant belt F3 is a ring-shaped endless belt, and it is wound around the outer circumferences of the pressure roller F2 and the belt tension member F4 so that it can be moved with being held between the heat fixing roller F1 and the pressure roller F2 in a pressed state. The heat resistant belt F3 is formed from a seamless tube having a thickness of 0.03 mm or more. Further, the seamless tube has a two layered structure in which its surface (which is the surface thereof that makes contact with the sheet material F5) is formed of PFA, and the opposite surface thereof (that is, the surface thereof that makes contact with the pressure roller F2 and the belt tension member F4) is formed of polyimide. However, the structure of the heat resistant belt F3 is not limited to the structure described above, it may be formed from other materials Examples of tubes formed from other materials include a metallic tube such as a stainless tube or a nickel electrocasting tube, a heat-resistance resin tube such as a silicone tube, and the like.

The belt tension member F4 is disposed on the upstream side of the fixing nip part between the heat fixing roller F1 and the pressure roller F2 in the sheet material F5 conveying direction. Further, the belt tension member F4 is pivotally disposed about the rotation shaft F2*a* of the pressure roller F2 so as to be movable along the arrow P. The belt tension member F4 is constructed so that the heat resistant belt F3 is extended with tension in the tangential direction of the heat fixing roller F1 in a state that the sheet material P5 does not pass through the fixing nip part. When the fixing pressure is large at an initial position where the sheet material F5 enters the fixing nip part, there is a case that the sheet material F5 can not enter the fixing nip part smoothly and thereby fixation is performed in a state that a tip part of the sheet material F5 is folded. However, in this embodiment, the belt tension member F4 is provided so that the heat resistant belt F3 is extended with tension in the tangential direction of the heat fixing roller F1 as described above, there is formed an introducing portion for smoothly introducing the sheet material F5, so that the sheet material F5 can be introduced into the fixing nip part in a stable manner.

The belt tension member F4 is a roughly semi-circular member for slidably guiding the heat resistant belt F3 (the heat resistant belt F3 slidably moves on the belt tension member F4). The belt tension member F4 is fitted into the inside of the heat resistant belt F3 so as to impart tension f to the heat resistant belt F3 in cooperation with the pressure roller F2. The belt tension member F4 is arranged at a position where a nip part is formed by pressing a part of the heat resistant belt F3 toward the heat fixing roller F1 over the tangential line L on the pressing portion at which the heat fixing roller F1 is pressed against the pressure roller F2. The protruding wall F4*a* is formed on any one or both of the end surfaces of the belt tension member F4 which are located in the axial direction thereof. The protruding wall E4 is provided for restricting the heat resistant belt F3 from being off to the side by abutment thereto in a case that the heat resistant belt F3 is deviated in any one of the sides. Further, a spring F9 is provided between the frame and an end portion of the protruding wall F4*a* which is located at an opposite side from the heat fixing roller F1 so as to slightly press the protruding wall F4*a* of the belt tension member F4 against the heat fixing roller F1. In this way, the belt tension member F4 is positioned with respect to the heat fixing roll F1 in slidably contact with the heat fixing roller F1.

In order to stably drive the heat resistant belt F3 by the pressure roller F2 in a state that the heat resistant belt F3 is wound around the pressure roller F2 and the belt tension member F4, the frictional coefficient between the pressure roll F2 and the heat resistant belt F3 is set to be larger than the frictional coefficient between the belt tension member F4 and the heat resistant belt F3. However, there is a case that these frictional coefficients become unstable due to enter of foreign substances between the heat resistant belt F3 and the pressure roller F2 or between the heat resistant belt F3 and the belt tension member F4, or due to the abrasion of the contacting part between the heat resistant belt F3 and the pressure roller F2 or the belt tension member F4.

Accordingly, the winding angle of the heat resistant belt F3 with respect to the belt tension member F4 is set to be smaller than the winding angle of the heat resistant belt F3 with respect to the pressure roller F2, and the diameter of the belt tension member F4 is set to be smaller than the diameter of the pressure roller F2. With this structure, the distance that the heat resistant belt F3 moves on the belt tension member F4 becomes short so that unstable factors due to deterioration with the elapse of time and disturbance can be avoided or reduced. As a result, it is possible to drive the heat resistant belt F3 with the pressure roller F2 in stable manner.

The cleaning member F6 is disposed between the pressure roller F2 and the belt tension member F4. The cleaning member F6 is provided for cleaning foreign substances or wear debris on the inner surface of the heat resistant belt F3 by slidably contacting with the inner surface of the heat resistant belt F3. By cleaning the foreign substances and wear debris in this way, it is possible to refresh the heat resistant belt F3 to eliminate the unstable factors on the frictional coefficients described above. Further, the belt tension member F4 is formed with a concave portion F4*f*, and this concave portion F4*f* is preferably used for collecting the foreign substances or wear debris eliminated from the heat resistant belt F3.

A position where the belt tension member F4 is slightly pressed against the heat fixing roller F1 is set as a nip beginning position and a position where the pressure roller F2 is pressed against the heat fixing roller F1 is set as nip ending position. The sheet material F5 enters the fixing nip part from the nip beginning position to pass through between the heat resistant belt F3 and the heat fixing roller F1, and then fed out from the nip ending position, and during these processes an unfixed toner image F5*a* is fixed on the sheet material F5 and then the sheet material F5 is discharged along the tangential line L of the pressing part between the heat fixing roller F1 and the pressing roller F2.

In the foregoing, the present invention was described based on the preferred embodiments, but the present invention is not limited to these embodiments.

For example, the liquid developer producing method of the present invention may include one or more additional processes for any purposes.

Further, although the liquid developer is produced using the kneaded material obtained by kneading the materials constituting the toner particles in the above embodiment, a material obtained by mixing the materials constituting the toner particles may be used instead of the kneaded material.

Furthermore, although the wet grinding is carried out using the coarse ground kneaded material, the coarse grinding process of the kneaded material may be omitted.

Moreover, although the wet grinding is carried out using only the first liquid in the above embodiment, the wet grinding may be carried out using a mixed liquid containing the first liquid and a relatively small amount of the second liquid. By carrying out the wet grinding in such a manner, it is possible to obtain the toner particles each having a sufficiently small size more effectively.

Moreover, although the coarse ground kneaded material is subjected to the wet grinding using the first liquid and it is then mixed with the second liquid, a part of the first liquid may be removed therefrom after the wet grinding process.

Moreover, a third liquid which is different from both the first liquid and the second liquid may be contained in a liquid used for the wet grinding other than the first liquid. A liquid whose viscosity is lower than that of the first liquid can be used as the third liquid, for example. By using such a third liquid, it becomes easy for the liquid used for the wet grinding to enter cracks or the like generated in the toner material during the coarse grinding process. Accordingly, efficiency of the wet grinding can further be improved and the toner particles having a sufficiently small size can be obtained more effectively. Examples of the third liquid include alcohols such as methanol and ethanol, mineral oils such as low viscosity liquid paraffin and silicone oil, and the like. In this regard, in a case where alcohols that have low electric resistance are used as the third liquid, the third liquid should be removed before being mixed with the second liquid to prevent the electric resistance of the finally obtained liquid developer from becoming lower than a desirable value. On the other hand, in a case where mineral oils that have high electric resistance are used as the third liquid, the third liquid may or may not be removed. Further, the liquid developer of the present invention is not limited to one that is used in the image forming apparatus as described above.

EXAMPLE

(1) Production of Liquid Developer

Example 1

Kneaded Material

First, 80 parts by weight of an epoxy resin ("Epikote 1004", softening point $T_f$: 128° C.) as a resin material, and 20 parts by weight of a cyanine pigment ("Pigment Blue 15:3", manufactured by Dainichiseika Color & Chemicals Mfg. Co., Ltd.) as a coloring agent were prepared.

These components were mixed using a 20 L type Henschel mixer to obtain a material for producing toner particles.

Next, the material (mixture) was kneaded using a biaxial kneader-extruder shown in FIG. 1. The entire length of a process section of the biaxial kneader-extruder was 160 cm. Further, the material temperature in the process section was set to be 105 to 115° C. Furthermore, the rotational speed of the screw was 120 rpm, and the speed for feeding the material into the kneader-extruder was 20 kg/hour.

Under these conditions, the time required for the material to pass through the process section was about 4 minutes.

The kneading was carried out with deairing the inside of the process section by driving a vacuum pump connected to the process section through a deairing port.

The material (kneaded material) kneaded in the process section was extruded outside the biaxial kneader-extruder from the head portion. The temperature of the kneaded material at the head portion was adjusted to be 135° C.

The kneaded material extruded from the extruding port of the biaxial kneader-extruder was cooled by a cooling machine as shown in FIG. 1. The temperature of the kneaded material just after the cooling process was about 45° C.

The cooling rate of the kneaded material was 9° C./sec. Further, the time required for the completion of the cooling process from the end of the kneading process was 10 seconds.

The kneaded material that had been cooled as described above was coarsely ground using a hammer mil to be formed into powder (a ground material) having an average particle size smaller than 1.0 mm.

Next, 100 parts by weight of the coarse ground material obtained as described above, 100 parts by weight of a methyl oleate (manufactured by KANTO CHEMICAL, INC.) as a first liquid, 10 parts by weight of a polyamine aliphatic condensation polymer ("SOLSPERSE 11200", manufactured by Lubrizol Japan Ltd.) as a dispersant and 1.0 part by weight of a magnesium stearate as a charge control agent were prepared. In the first liquid, the electric resistance at room temperature (20° C.) was $2.8\times10^{13}$ Ωcm, the dielectric constant was 2.8, and the viscosity at room temperature (20° C.) was 4.0 mPa·s. These components were put into a ball mill and then subjected to wet grinding for 200 hours to thereby obtain a ground material dispersed liquid.

Next, 100 parts by weight of the thus obtained ground material dispersed liquid and 400 parts by weight of a soybean oil ("soybean oil", manufactured by J-OIL MILLS, INC.) as a second liquid were mixed to thereby obtain a liquid developer. In the second liquid, the electric resistance at room temperature (20° C.) was $1.3\times10^{13}$ Ωcm, the dielectric constant was 3.0, and the viscosity at room temperature (20° C.) was 55 mPa·s. Further, the amount of fatty acid triglyceride (a main component thereof: linoleic acid triglyceride) contained in the soybean oil was 96 wt %.

In the thus obtained liquid developer, the average particle size of the toner particles was 2.5 μm and the standard deviation in the particle size of the toner particles was 0.48 μm. Further, the viscosity of the liquid developer at room temperature (20° C.) was 65 mPa·s. In this regard, when the insulation liquid contained in the liquid developer was subjected to centrifugal separation and the viscosity of the insulation liquid was measured, the viscosity was 50 mPa·s.

Example 2

A liquid developer was prepared in the same manner as in the Example 1 except that a butyl oleate (manufactured by KANTO CHEMICAL, INC.; viscosity (20° C.): 6.0 mPa·s) was used as the first liquid.

Example 3

A liquid developer was prepared in the same manner as in the Example 1 except that a dehydrated castor oil (manufactured by ITOH OIL CHEMICALS CO., LTD.; viscosity (20° C.): 230 mPa·s) was used as the second liquid. In this regard, the amount of fatty acid triglyceride (a main component thereof: octadecadienoic acid triglyceride) contained in the dehydrated castor oil was 100 wt %.

Examples 4 to 6

In each of these Examples, a liquid developer was prepared in the same manner as in the Example 1 except that the first liquid and the second liquid were changed to those shown in Table 1.

Comparative Example 1

First, a coarse ground material was obtained in the same manner as in the Example 1.

Next, 100 parts by weight of the thus obtained coarse ground material, 100 parts by weight of a methyl oleate (manufactured by KANTO CHEMICAL, INC., viscosity (20° C.): 4.0 mPa·s) as a insulation liquid, 10 parts by weight of a polyoxyethylene alkyl ether as a dispersant and 1.0 part by weight of a magnesium stearate as a charge control agent were prepared.

Next, these components were put into a ball mill and then subjected to wet grinding for 200 hours to thereby obtain a ground material dispersed liquid. Then, 100 parts by weight of the thus obtained ground material dispersed liquid and 400 parts by weight of a methyl oleate were mixed to thereby obtain a liquid developer.

Comparative Example 2

First, a coarse ground material was obtained in the same manner as in the Example 1.

Next, 100 parts by weight of the thus obtained coarse ground material, 100 parts by weight of a soybean oil (manufactured by J-OIL MILLS, INC., viscosity (20° C.): 55 mPa·s) as a insulation liquid, 10 parts by weight of a polyoxyethylene alkyl ether as a dispersant and 1.0 part by weight of a magnesium stearate as a charge control agent were prepared.

Next, these components were put into a ball mill and then subjected to wet grinding for 300 hours. However, toner particles having a sufficiently small size could not be obtained.

Comparative Example 3

First, a coarse ground material was obtained in the same manner as in the Example 1.

Next, 100 parts by weight of the thus obtained coarse ground material, 100 parts by weight of ISOPER H (manufactured by Exxon Chemical Company) as a insulation liquid, 10 parts by weight of a polyoxyethylene alkyl ether as a dispersant and 1.0 part by weight of a magnesium stearate as a charge control agent were prepared. In the ISOPER H, the electric resistance at room temperature (20° C.) was $1.6\times10^{15}$ Ωcm, the dielectric constant was 2.5, and the viscosity at room temperature (20° C.) was 1.95 mPa·s.

Next, these components were put into a ball mill and then subjected to wet grinding for 200 hours to thereby obtain a ground material dispersed liquid. Then, 100 parts by weight of the thus obtained ground material dispersed liquid and 400 parts by weight of ISOPER H were mixed to thereby obtain a liquid developer.

The conditions for producing the liquid developers of the Examples 1 to 6 and the Comparative Examples 1 to 3 are shown in the following Table 1.

TABLE 1

| | resin material | | insulation liquid | | | | | | | | | |
|---|---|---|---|---|---|---|---|---|---|---|---|---|
| | | | first liquid | | | second liquid | | | | | | |
| | kind | softening point [° C.] | kind | viscosity $V_1$ [mPa · s] | electric resistance [Ωcm] | Kind | viscosity $V_2$ [mPa · s] | electric resistance [Ωcm] | viscosity [mPa · s] | electric resistance [Ωcm] | $V_1/V_2$ | wet grinding time |
| EX. 1 | epoxy rein | 128 | methyl oleate | 4.0 | $2.8\times10^{13}$ | soybean oil | 55 | $1.3\times10^{13}$ | 50 | $3.5\times10^{13}$ | 0.072 | 200 |
| EX. 2 | epoxy rein | 128 | butyl oleate | 6.0 | $5.0\times10^{13}$ | soybean oil | 55 | $1.3\times10^{13}$ | 60 | $4.3\times10^{13}$ | 0.109 | 200 |
| EX. 3 | epoxy rein | 128 | methyl oleate | 4.0 | $2.8\times10^{13}$ | dehydrated castor oil | 230 | $6.0\times10^{11}$ | 161 | $3.1\times10^{12}$ | 0.017 | 200 |
| EX. 4 | polyester resin | 124 | methyl oleate | 4.0 | $2.8\times10^{13}$ | soybean oil | 55 | $1.3\times10^{13}$ | 51 | $3.6\times10^{13}$ | 0.072 | 200 |
| EX. 5 | St-Ac* copolymer | 125.6 | methyl oleate | 4.0 | $2.8\times10^{13}$ | soybean oil | 55 | $1.3\times10^{13}$ | 52 | $3.7\times10^{13}$ | 0.072 | 200 |
| EX. 6 | epoxy rein | 128 | methyl oleate | 50 | $2.8\times10^{13}$ | soybean oil | 55 | $1.3\times10^{13}$ | 50 | $3.5\times10^{13}$ | 0.909 | 200 |
| Com. Ex. 1 | epoxy rein | 128 | methyl oleate | 4.0 | $2.8\times10^{13}$ | — | — | — | 5.5 | $2.8\times10^{13}$ | — | 200 |
| Com. Ex. 2 | epoxy rein | 128 | soybean oil | 55 | $1.3\times10^{13}$ | — | — | — | — | $1.3\times10^{13}$ | — | 300 |
| Com. Ex. 3 | epoxy rein | 128 | ISOPER H | 1.95 | $1.6\times10^{15}$ | — | — | — | — | $1.6\times10^{15}$ | — | 200 |

*St-Ac—Styrene-acrylic (2) Evaluation

For the respective liquid developers obtained as described above, dispersion stability, fixing strength, storage stability and electrification property were evaluated.

(2.1) Dispersion Stability 10 mL of each of the liquid developers obtained in the Examples 1 to 6 and the Comparative Examples 1 to 3 was put into a centrifuging tube and centrifugalised under the condition of 1000 G for 10 minutes. Then, 200 μL of supernatant liquid thereof was collected and then diluted by 100 times with the second liquid (the insulation liquid, in the Comparative Examples) for using as a sample.

Next, in the respective sample, an absorption wavelength was measured using a visible-ultraviolet spectrophotometer ("V-570", manufactured by JASCO Corporation). The measurement results were evaluated according to the following four criteria based on absorbance of an absorption range (685 nm) of a cyanogen-based pigment.

A: Absorbance was 1.50 or higher (settling of toner particles was not observed at all).

B: Absorbance was 1.00 or higher but lower than 1.50 (settling of toner particles was scarcely observed).

C: Absorbance was 0.50 or higher but lower than 1.00 (settling of toner particles was observed).

D: Absorbance was lower than 0.50 (settling of toner particles were clearly observed and the settling begins even in a state of being left under natural conditions).

(2.2) Fixing Strength

By using the image forming apparatus shown in FIG. 2, images having a predetermined pattern were formed on recording papers ("High quality paper LPCPPA4", product of Seiko Epson Corporation) employing the liquid developers of the Examples 1 to 6 and the Comparative Examples 1 to 3, respectively. Then, the images formed on the papers were thermally fixed onto the papers using an oven. The thermal fixing was carried out under the conditions of 120° C. for 30 minutes.

Thereafter, after it was confirmed as to whether or not a non-offset area was present, the fixed image on each of the papers was rubbed out twice using a sand eraser ("LION 261-11", Product of LION OFFICE PRODUCTS CORP.) with a pressure loading of 1.0 kgf/cm$^2$. Then, the residual rate of the image density of each recording paper was measured by a calorimeter "X-Rite model 404" (X-Rite Incorporated), and the measurement results were evaluated according to the following four criteria.

A: Residual rate of the image density was 90% or higher.

B: Residual rate of the image density was 80% or higher but lower than 90%.

C: Residual rate of the image density was 70% or higher but lower than 80%.

D: Residual rate of the image density was lower than 70%.

(2.3) Storage Stability

The liquid developers obtained in the Examples 1 to 6 and the Comparative Examples 1 to 3 were being placed under the atmosphere in which temperature was in the range of 15 to 20° C. for six months. Thereafter, conditions of the toner particles in the liquid developers were visually observed, and the observation results were evaluated by the following four criteria.

A: Aggregation and settling of toner particles were not observed at all.

B: Aggregation and settling of toner particles were scarcely observed.

C: Aggregation and settling of toner particles were slightly observed.

D: Aggregation and settling of toner particles were clearly observed.

(2.4) Electrification Property

By using a laser zeta electrometer "ELS-6000" (manufactured by OTSUKA ELECTRONICS CO., LTD.), electrification properties of the liquid developers obtained in the Examples 1 to 6 and the Comparative Examples 1 to 3 were evaluated by the following four criteria.

A: Electric potential difference was +50 mV or larger.

B: Electric potential difference was +45 mV or larger but smaller than +50 mV.

C: Electric potential difference was +30 mV or larger but smaller than +45 mV.

D: Electric potential difference was smaller than +30 mV.

These results are shown in the following Table 2 together with the average particle size based on volume and the standard deviation in the particle size of the toner particles.

TABLE 2

| | average particle size [μm] | standard deviation of particle size [μm] | viscosity of liquid developer [mPa · s] | evaluation | | | |
|---|---|---|---|---|---|---|---|
| | | | | dispersion stability | fixing strength | storage stability | electrification property |
| EX. 1 | 2.5 | 0.48 | 65 | A | A | A | A |
| EX. 2 | 2.6 | 0.48 | 70 | B | A | B | A |
| EX. 3 | 2.4 | 0.46 | 184 | A | A | A | B |
| EX. 4 | 2.5 | 0.48 | 68 | A | A | A | A |
| EX. 5 | 2.7 | 0.49 | 66 | B | A | B | A |
| EX. 6 | 2.8 | 0.47 | 80 | A | A | A | B |
| Com. Ex. 1 | 2.6 | 0.48 | 21 | D | C | D | C |
| Com. Ex. 2 | — | — | — | — | — | — | — |
| Com. Ex. 3 | 2.4 | 0.45 | 10 | D | C | D | C |

As shown in the Table 2, the liquid developers according to the present invention (that is, the liquid developers of the Examples 1 to 6) had excellent dispersion stability, fixing strength, storage stability and electrification property. In contrast, in the liquid developers of the Comparative Examples 1 to 3, satisfactory results could not be obtained.

Further, when images having a predetermined pattern were formed on recording papers ("High quality paper LPCPPA4", product of Seiko Epson Corporation) employing the liquid developers of the Examples 1 to 6 by using the image forming apparatus shown in FIG. 2, clear and even images could be obtained. In contrast, in images that were formed employing the liquid developers of the Comparative Examples 1 to 3, unevenness was observed. This is attributed to the fact that the liquid developers of the Comparative Examples were not supplied sufficiently uniformly to the application roller of the image forming apparatus.

Furthermore, liquid developers which are the same as those described above were produced except that as a coloring agent a pigment red 122, a pigment yellow 180, and a carbon black ("Printex L", manufactured by Degussa AG) were used instead of a cyanogen-based pigment, and they were evaluated in the same manner as described above. As a result, substantially the same results could be obtained.

Finally, it is to be noted that the present invention is not limited to the embodiments and the examples described above, and many additions and modifications may be made without departing from the spirit of the present invention which are defined by the following claims.

What is claimed is:

1. A method for producing a liquid developer comprising an insulation liquid and toner particles dispersed in the insulation liquid, the method comprising the steps of:

a wet grinding step for grinding a toner material mainly composed of a resin material in a first liquid which contains as its main component a fatty acid monoester to obtain a ground material dispersed liquid; and a mixing step for mixing the ground material dispersed liquid and a second liquid which contains as its main component a fatty acid triglyceride, wherein the first and second liquids constitute the insulation liquid, and the ground resin material dispersed in the insulation liquid constitutes the toner particles.

2. The method for producing a liquid developer as claimed in claim 1, wherein the viscosity of the first liquid is in the range of 0.5 to 60 mPa·s.

3. The method for producing a liquid developer as claimed in claim 1, wherein the viscosity of the second liquid is in the range of 30 to 500 mPa·s.

4. The method for producing a liquid developer as claimed in claim 1, wherein the first liquid contains a dispersant, and the toner material is ground in such first liquid in the wet grinding step.

5. The method for producing a liquid developer as claimed in claim 1, wherein the fatty acid monoester is an unsaturated fatty acid alkyl ester.

6. The method for producing a liquid developer as claimed in claim 1, wherein the fatty acid monoester is an oleic acid alkyl ester.

7. The method for producing a liquid developer as claimed in claim 1, wherein the second liquid contains an unsaturated fatty acid triglyceride as the fatty acid triglyceride.

8. The method for producing a liquid developer as claimed in claim 1, wherein the resin material includes at least one of an epoxy resin and a polyester resin.

9. A liquid developer, comprising:

an insulation liquid comprising a first liquid which contains as its main component a fatty acid monoester and a second liquid which contains as its main component a fatty acid triglyceride; and toner particles dispersed in the insulation liquid, wherein the toner particles are obtained through a wet grinding process in which a toner material mainly composed of a resin material is ground in the first liquid so that the ground toner material is finely dispersed in the first liquid, and the liquid developer is obtained by mixing the first liquid containing the ground toner material with the second liquid.

10. An image forming apparatus for forming an image onto a recording medium using a liquid developer, wherein the liquid developer comprises:

an insulation liquid comprising a first liquid which contains as its main component a fatty acid monoester and a second liquid which contains as its main component a fatty acid triglyceride; and toner particles dispersed in the insulation liquid, wherein the toner particles are obtained through a wet grinding process in which a toner material mainly composed of a resin material is ground in the first liquid so that the ground toner material is finely dispersed in the first liquid, and the liquid developer is obtained by mixing the first liquid containing the ground toner material with the second liquid.

11. The image forming apparatus as claimed in claim 10, which comprises:

a liquid developer storage section for storing the liquid developer therein;

a developing section for developing a toner image using the liquid developer supplied from the liquid developer storage section, and the developing section including a photoreceptor on which a latent image is to be formed and an application roller and a development roller for supplying the liquid developer in the liquid developer storage section to the photoreceptor for developing the latent image;

an image transfer section for transferring the developed latent image formed on the photoreceptor onto the recording medium to form a transferred image thereon; and a fixing section for fixing the transferred image formed on the recording medium onto the recording medium.

12. The image forming apparatus as claimed in claim 11, wherein a part of the application roller is immersed in the developer in the liquid developer storage section.

* * * * *